US011470412B2

(12) United States Patent
McAllister, II

(10) Patent No.: US 11,470,412 B2
(45) Date of Patent: Oct. 11, 2022

(54) HEADPHONE PROTECTOR

(71) Applicant: Carl D McAllister, II, Kalamazoo, MI (US)

(72) Inventor: Carl D McAllister, II, Kalamazoo, MI (US)

( * ) Notice: Subject to any disclaimer, the term of this patent is extended or adjusted under 35 U.S.C. 154(b) by 0 days.

(21) Appl. No.: 17/006,734

(22) Filed: Aug. 28, 2020

(65) Prior Publication Data

US 2021/0176551 A1 Jun. 10, 2021

Related U.S. Application Data

(63) Continuation of application No. 15/499,858, filed on Apr. 27, 2017, now abandoned.

(60) Provisional application No. 62/328,583, filed on Apr. 27, 2016.

(51) Int. Cl.
*H04R 1/10* (2006.01)
*H04R 1/02* (2006.01)

(52) U.S. Cl.
CPC ..... *H04R 1/1008* (2013.01); *H04R 1/105* (2013.01); *H04R 1/1058* (2013.01); *H04R 1/023* (2013.01)

(58) Field of Classification Search
CPC .... H04R 1/10; H04R 2205/022; H04R 1/105; H04R 5/0335; H04R 2201/10
USPC ..... 381/370–372, 374
See application file for complete search history.

(56) References Cited

U.S. PATENT DOCUMENTS 4,669,129 A * 6/1987 Chance ..... A61F 11/06 381/372
5,835,609 A * 11/1998 LeGette ..... A61F 11/14 2/209
7,668,330 B2 * 2/2010 Siskin ..... A61F 11/14
8,111,859 B2 * 2/2012 Phillips ..... H04R 5/0335 381/376
9,854,348 B2 * 12/2017 Naylor-Warren .... H04R 1/1066
10,075,786 B2 * 9/2018 Larsen ..... H04R 1/023
2004/0184635 A1 * 9/2004 Natvig ..... H04R 1/1058 381/371
2008/0304691 A1 * 12/2008 Lai ..... H04R 5/0335 381/386
2014/0321661 A1 * 10/2014 Alao ..... H04R 5/0335 381/74
2016/0143385 A1 * 5/2016 Krissman ..... H04R 1/10 224/576
2016/0269814 A1 * 9/2016 Rye ..... H04R 1/1066

* cited by examiner

*Primary Examiner* — Suhan Ni

(57) ABSTRACT

Some embodiments of the present invention include a headphone protector wherein said protector fits over existing ear cushions of over-ear headphones, wherein said protector comprises an outer component, and said protector comprises at least one water-resistant fabric. Some embodiments of the present invention include a headband protector, wherein said protector fits over existing headband of over-ear headphones, wherein said protector comprises an outer component, and said protector comprises at least one water-resistant fabric. Some embodiments of the present invention include a system for over-ear headphone protection, comprising two headphone protectors, wherein said protectors fit over existing ear cushions of over-ear headphones, wherein said protectors comprise an outer component, and said protectors comprise at least one water-resistant fabric.

18 Claims, 11 Drawing Sheets

HEADPHONE PROTECTOR

CROSS REFERENCE TO RELATED APPLICATION

This application claims priority to U.S. Provisional Application No. 62/328,583, filed Apr. 27, 2016.

BACKGROUND

On hot humid days, or for those who like to listen to music while they exercise, sweat is inevitable when wearing over-the-ear headphones for extended periods of time. If the headphones aren't cleaned on a regular basis, sweat residue and bacteria build up, leading to skin irritation as well as the deterioration of the headphone itself, including, for example, the ear cushions, the headband, external ports, cords and other components, which are often made of plastic, leather, vinyl and other materials that may degrade over time under such conditions. Various cleaning materials may not adequately sterilize headphones sufficiently, may ruin headphone material, or pose as a threat to exposed skin. The purpose of the present invention is to reduce the amount of bacteria and sweat that gets transferred to the headphone, via a barrier that protects the headphones against sweat and bacteria that, in some embodiments, can also be removed and cleaned after utilization.

SUMMARY OF THE INVENTION

Some embodiments of the present invention include a headphone protector wherein said protector fits over existing ear cushions of over-ear headphones, wherein said protector comprises an outer component, and said protector comprises at least one water-resistant fabric.

In other embodiments, said outer component is comprised of a water-resistant fabric. In other embodiments, said protector further comprises a water-absorbent fabric. In yet other embodiments, said protector comprises an inner and outer surface, wherein said inner surface is waterproof. In other embodiments, said protector further consists of an inner liner material, wherein said inner liner material is fused to the outer component.

In still other embodiments, said protector further consists of an inner liner material, wherein said inner liner material is detachable from the outer component. In yet other embodiments, said outer component comprises an internal rim that defines a hole, to allow for sound to emit from the headphone. In other embodiments, said outer component comprises an external rim that is reinforced to allow for said protector to fit securely over the ear cushions of an over-ear headphone protector. In still other embodiments, the outer component comprises neoprene, lycra, polyester, nylon, polybutylene terephthalate (PBT) polyester, XLA fabric, or a blend of any of the same. In other embodiments, the inner layer comprises latex, or neoprene, or a blend of any of the same.

Some embodiments of the present invention include a headband protector, wherein said protector fits over existing headband of over-ear headphones, wherein said protector comprises an outer component, and said protector comprises at least one water-resistant fabric.

Some embodiments of the present invention include a system for over-ear headphone protection, comprising two headphone protectors, wherein said protectors fit over existing ear cushions of over-ear headphones, wherein said protectors comprise an outer component, and said protectors comprise at least one water-resistant fabric.

In some embodiments of the system, said protectors further comprise a water-absorbent fabric. In other embodiments of the system, said protector further consists of an inner liner material, wherein said inner liner material is fused to the outer component. In other embodiments, said protector further consists of an inner liner material, wherein said inner liner material is detachable from the outer component. In yet other embodiments, said outer component comprises an internal rim that defines a hole, to allow for sound to emit from the headphone. In still other embodiments, said outer component comprises an external rim that is reinforced to allow for said protector to fit securely over the ear cushions of an over-ear headphone protector.

Still other embodiments of the present system further comprise a headband protector, wherein said headband protector fits over existing headband of over-ear headphones, wherein said protector comprises an outer component, and said protector comprises at least one water-resistant fabric.

DETAILED DESCRIPTION OF THE INVENTION

Figure 1:
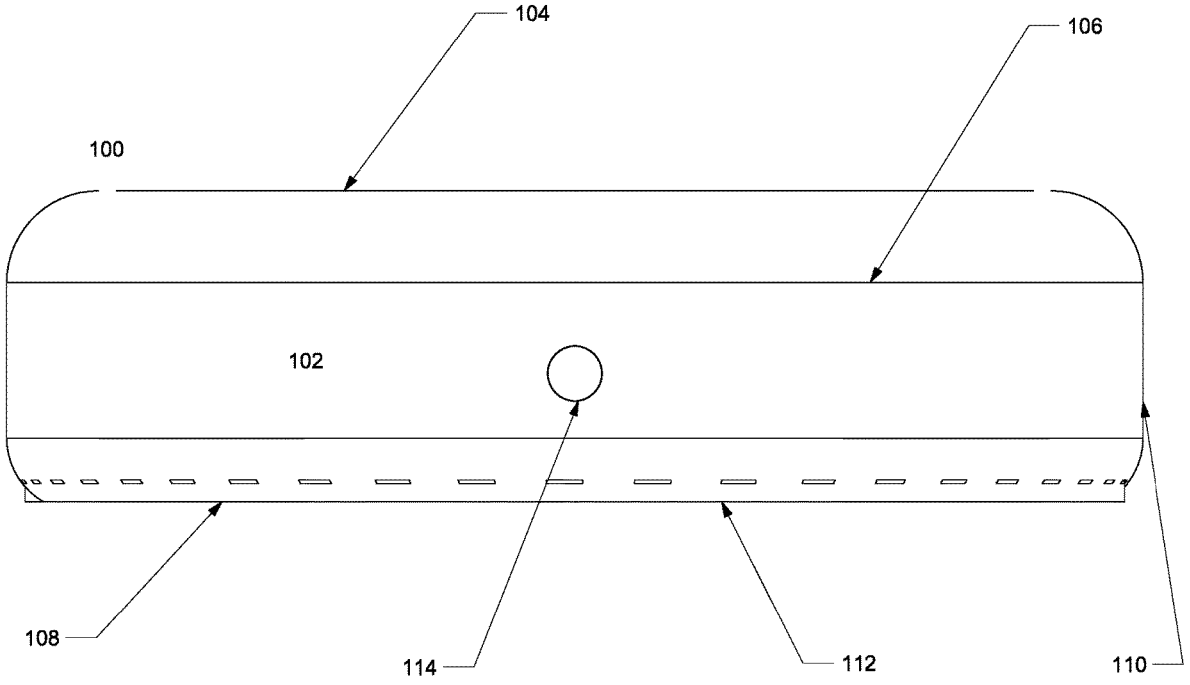
FIG. 1 is a perspective bottom view of an outer component of an embodiment of the present invention.

Before any embodiments or aspects of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

In some embodiments of the ear protector of the present invention, the headphone protector will be designed to be stretched to some extent, over the ear cushions, in order to stay in place. In many embodiments, the headphone protector will be made of a fairly loose (non-stiff) fabric (as detailed below) so as not to unduly compress the cushioning of the ear cushions when placed over them. Thus, the shape of the headphone protector when not on the ear cushions may be variable in many embodiments; for purposes of clear illustration, example embodiments depicted in the drawings and description below will be portrayed in use, that is, when stretched or otherwise attached over an ear cushion.

"Front" in the context of this application, refers to the ear-cushion side of a pair of headphones, i.e., the direction of the side facing the head when in normal use. The "rear" direction refers to the side of a pair of headphones facing away from the head. When covering an ear cushion, the "outer" side of the protector refers to the side of the headphone protector facing the user, "inner" the other side of the protector, i.e. facing the headphone body itself. In many embodiments, the headphone protector is freely rotatable, such that there is no fixed "top" or "bottom" of the protector itself. Nonetheless, a "bottom view" is a view of the headphone protector from a view opposite of where the headband of the headphones attaches to the ear cushions, and a "top view" the opposite orientation. The "internal" direction refers to the inner perimeter of the headphone protector, closest to the sound holes of the headphone when placed over the ear cushions of the headphone; "external" refers to the outer perimeter of the headphone protector, toward the outer edge of the ear cushions when placed over the ear cushions of the headphone FIG. 1 is a bottom perspective view of an example embodiment of the outside of the outer component 100 of an embodiment of the headphone protector. In this embodiment, the middle portion 102 of the outer component is shown, which is what will cover the majority of the ear cushion of the headphone. The front of the outside of the outer component 104 is the portion that will come in contact with head and ear of its user. The dotted line 106 shows where the inside component of the headphone protector will fit in some embodiments within the outer component when in use. In some embodiments, an elastic band is stitched in place (stitching on the outside of the outer component 108 may be visible in some embodiments) to keep it connected to the headphone protector, and which helps hold the headphone protector in place, behind and underneath the ear cushion of over-the-ear headphones (as discussed and shown later). The outer component extends around sides 110, and the back portion of outer surface of the outer headphone protector 112 faces the headband of the headphone protector. In some embodiments, a hole 114 is placed within the component 102, for headphones that are not wireless. The headphone wire would be fed through this hole and into the desired device into its headphone jack. Hole 114 may be placed in any portion of the outer and/or inner component (e.g., component 112) to accommodate a particular headphone jack location. As will be appreciated by those of skill in the art, the outer component may in some embodiments be rotatable around the ear cushion, to orient hole 114 into the right location to allow easy access to the headphone jack.

Figure 2:
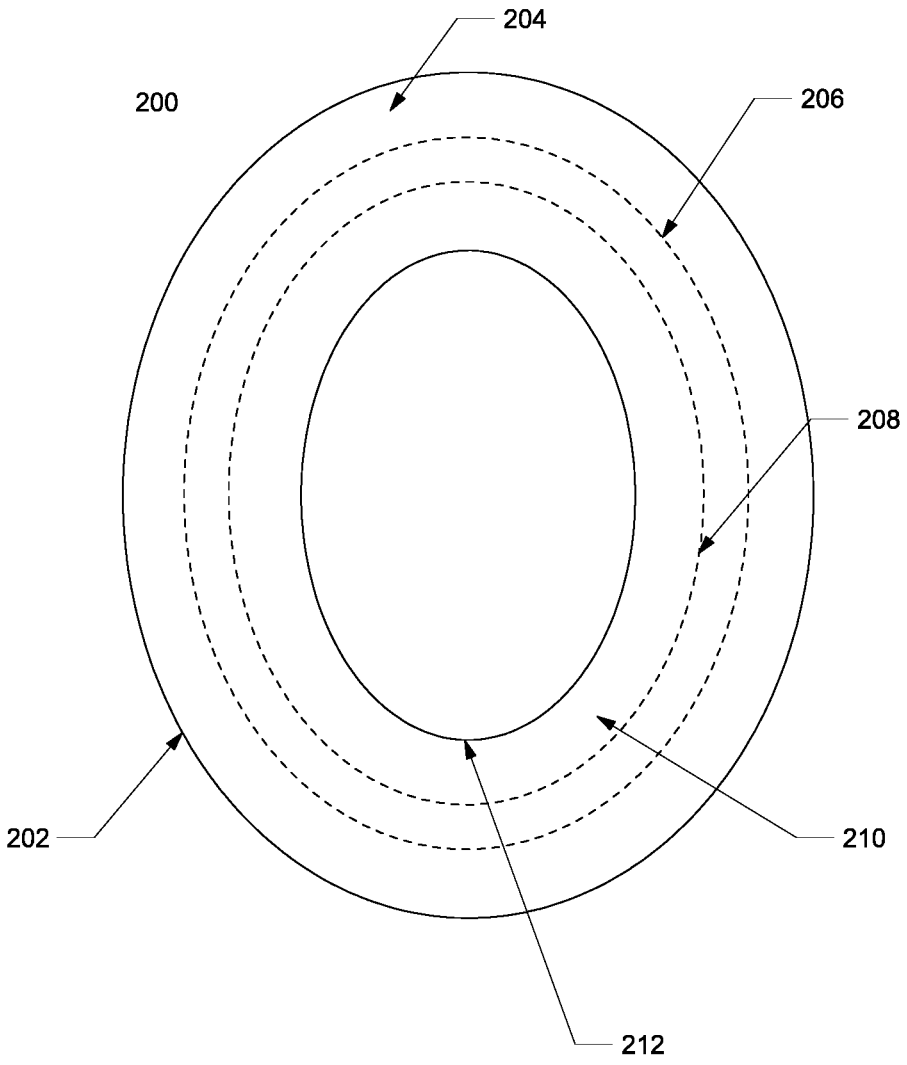
FIG. 2 is a perspective front view illustrating an outer component of an embodiment of the present invention.

FIG. 2 is a perspective front view of an example embodiment of the outside of the outer component of the headphone protector 200. The external surface 202 extends over the external surface of the ear cushion when in use. External surface 202 may be flat or curved; the exact dimensions are controlled by the shape of the ear cushions in some embodiments, where the fabric is less stiff than the ear cushion surface when stretched. In other embodiments, the fabric is stiffer and may have a fixed or more defined shape. When in place over the ear cushion, the outside of the outer component curves at 204 between the front of outer component at 206 and the external rim 202. The exact dimensions of this curve are controlled by the shape of the ear cushions in some embodiments, where the fabric is less stiff than the ear cushion surface when stretched. In other embodiments, the fabric is stiffer and may have a fixed or more defined curve 204 such that the curve shape is generated by the headphone protector itself. Between 206 and 208, embodiments of the headphone protector may be flat, i.e., not curved, or have a shallower curve than 204. In some embodiments, the outside of the outer component at 210 curves between the front of outer component 208 and the internal rim 212. As for curve 204, the exact dimensions of curve 210 are controlled by the shape of the ear cushions in some embodiments, where the fabric is less stiff than the ear cushion surface when stretched. In other embodiments, the fabric is stiffer and may have a fixed or more defined curve 210 such that the curve shape is generated by the headphone protector itself. In some embodiments, internal rim 212 will fit tightly with the inside of the headphone ear cushion when in use. In other embodiments, internal rim 212 will define a hole that allows for sound to emit from the headphones, and may or may not fit tightly with the inside of the headphone. In some embodiments, internal rim 212 is defined and/or reinforced with stitching, to define and/or strengthen the rim of the headphone protector.

Figure 3:
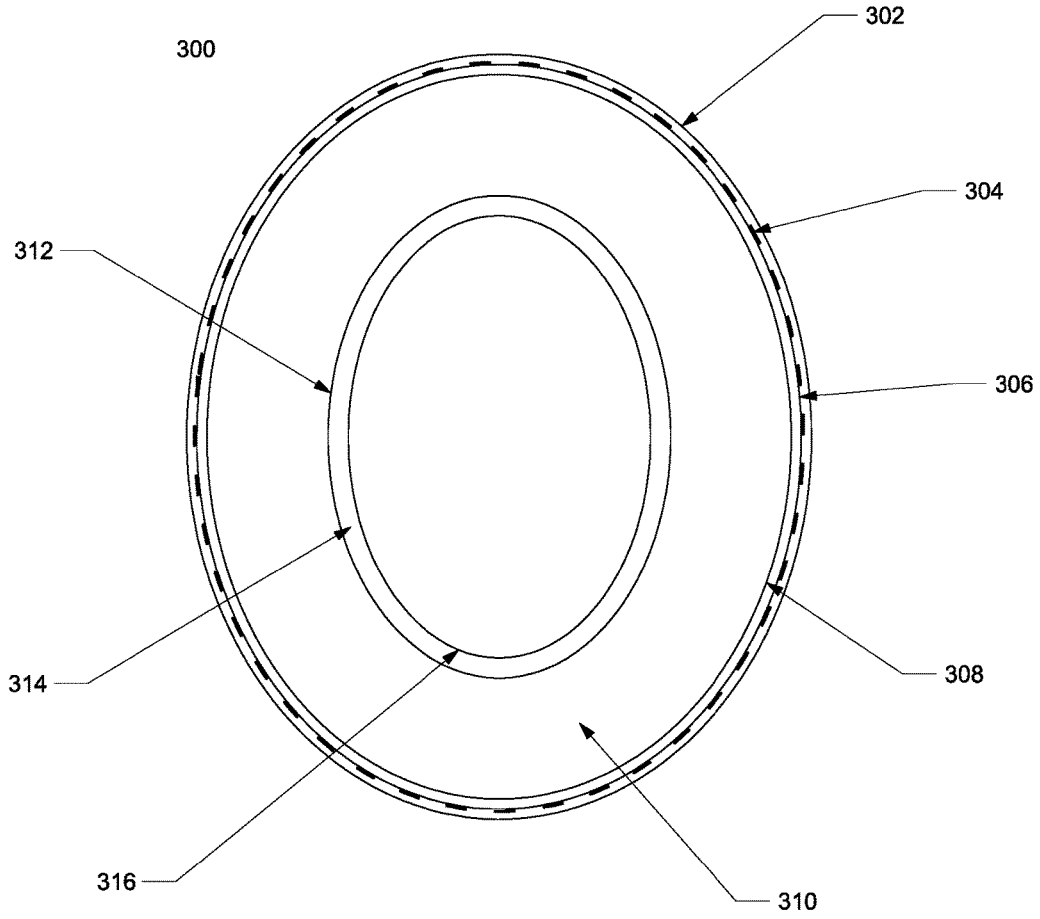
FIG. 3 is a perspective rear-view of an outer component of the headphone protector of an embodiment of the present invention.

FIG. 3 is a perspective rear view of an example embodiment of the inside of the outer component 300 component of the headphone protector that fits onto the ear cushion of the headphone, viewed from the orientation of the rear of the headphones. (Note that for clarity of presentation, the actual headphone is omitted from this drawing, but the shape of the outer component 300 is presented as if it is fit around the headphone ear cushion.) In some embodiments, when stretched over an ear cushion, the external surface 302 of the outer component wraps around the ear cushion and attaches to the rear of the ear cushion. In this example embodiment, the external surface 302 wraps around the ear cushion and is held in place by stitching 304. Thus, external rim 308 faces the rear of the headphones in this orientation. Inner surface 310 serves as the inside wall of the headphone protector which will be in in direct contact with the front part of the ear cushion on the headphone. As explained in greater detail below, inner surface 310 may comprise the same material as outer surface 302, or may be treated with waterproofing material. Internal rim 316 may, in some embodiments, be associated with a strengthened area 314, which may extend from 312 to 316. This strengthened area 314 may serve to define or strengthen the internal rim 316 to preserve the shape of the headphone protector when in use or to protect the rim from damage. The strengthened area 314 may comprise, for example, reinforcing stitching, or additional material.

Figure 4:
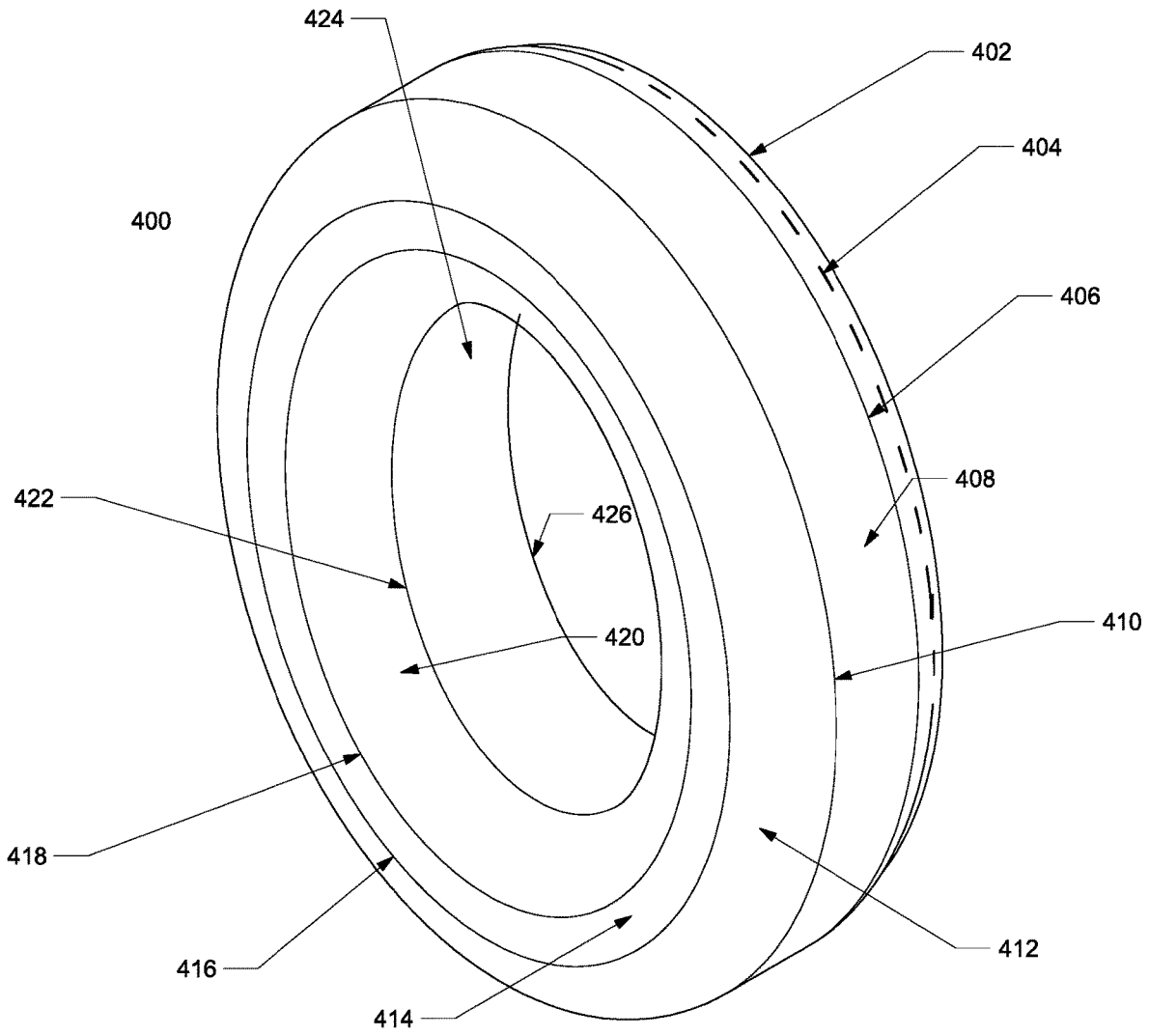
FIG. 4 Is a perspective isometric view of an outer component of an embodiment of the present invention.
Figure 5:
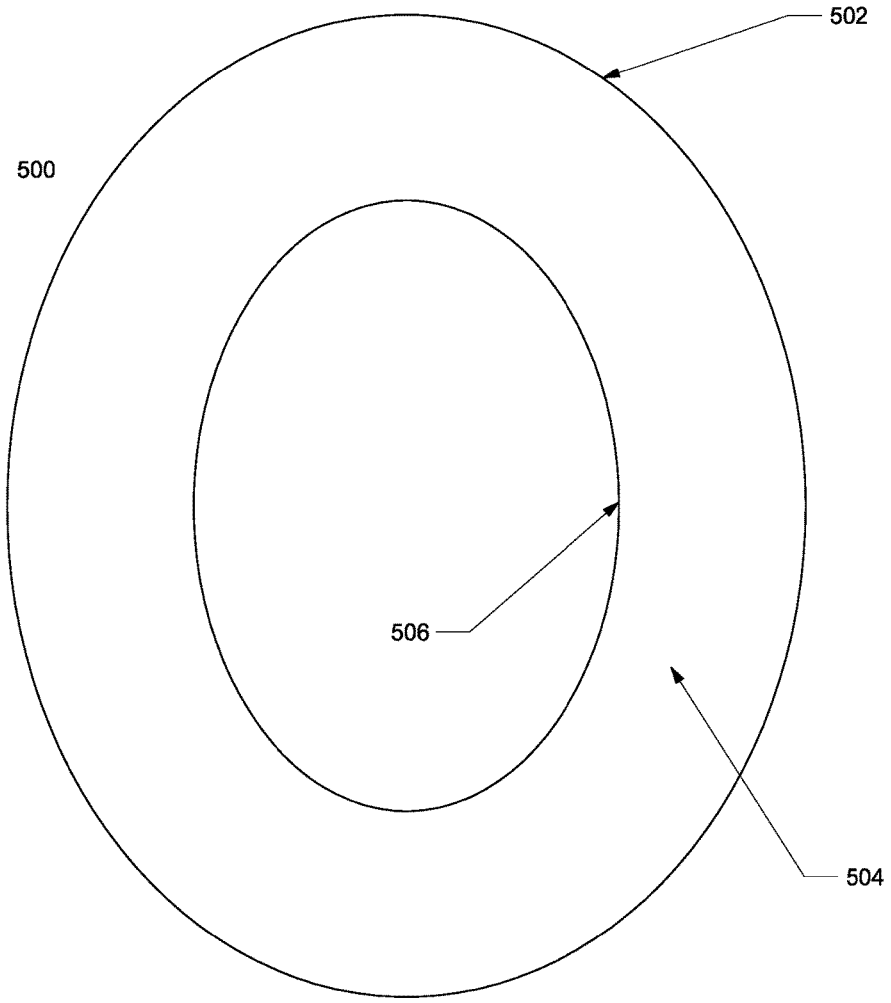
FIG. 5 is a perspective front-side view of an inner liner of an embodiment of the present invention.

FIG. 4 is a perspective isometric view of an example embodiment of headphone protector 400. It illustrates the overall appearance of the headphone protector of the ear cushion, as it will be the only part visible. External rim 402 faces the rear of the headphones, i.e., facing the headband of the headphone. In some embodiments, stitching 404 may be made of elastic or some other material that helps binds the headphone protector 400 to the headphone ear cushions. The lateral side surface 408 may be flat (i.e., maintaining the same distance to the center of the headphone ear cushion around the entirety of headphone protector 400) extending from 406 to 410, but 406 and 410 may be various distances apart depending on the particular headphone shape and/or embodiment of the present invention. Surface 412 is curved in this embodiment and extends from 410 to 416, which may be various distances apart depending on the particular headphone shape and/or embodiment of the present invention. Surface 414 is curved in this embodiment to fit the shape of the underlying ear cushion and extends from 416 to 418, which may be various distances apart depending on the particular headphone shape and/or embodiment of the present invention. Surface 420 is curved in this embodiment to fit the shape of the underlying ear cushion and extends from 418 to 422, which may be various distances apart depending on the particular headphone shape and/or embodiment of the present invention. Surface 424 is flat in this embodiment to fit the shape of the underlying ear cushion and extends from 422 to internal rim 426, which may be various distances apart depending on the particular headphone shape and/or embodiment of the present invention. As noted above, the shape of surfaces 408, 412 414, 420, and 424 may be more or less flat or curved, which may be controlled by the shape of the ear cushions in some embodiments, where the fabric is less stiff than the ear cushion surface when stretched. In other embodiments, the fabric is stiffer and may have a fixed or more defined curve such that the curve shape is generated by the headphone protector itself.

In some embodiments, the inner surface of the headphone protector may consist in whole or in part of an inner liner 500. This inner liner may be detachable or fused or otherwise attached (e.g., stitched to) to outer component of the headphone protector. In some embodiments, the inner liner is waterproof. In some embodiments, the inner surface of the outer component has been waterproofed; for terms of description, such a waterproofing layer will also be considered as a non-detachable inner liner. In some embodiments, inner liner 500 is a synthetic rubber-like material that is soft and waterproof, such as neoprene. In some embodiments, inner liner 500 extends from inner liner external rim 502 to internal rim 506. In some embodiments, the inner liner extends across the internal surface of the outer component from external rim 502 to external rim 502; in some embodiments the inner liner extends from internal rim 506 to internal rim 506.

Figure 6:
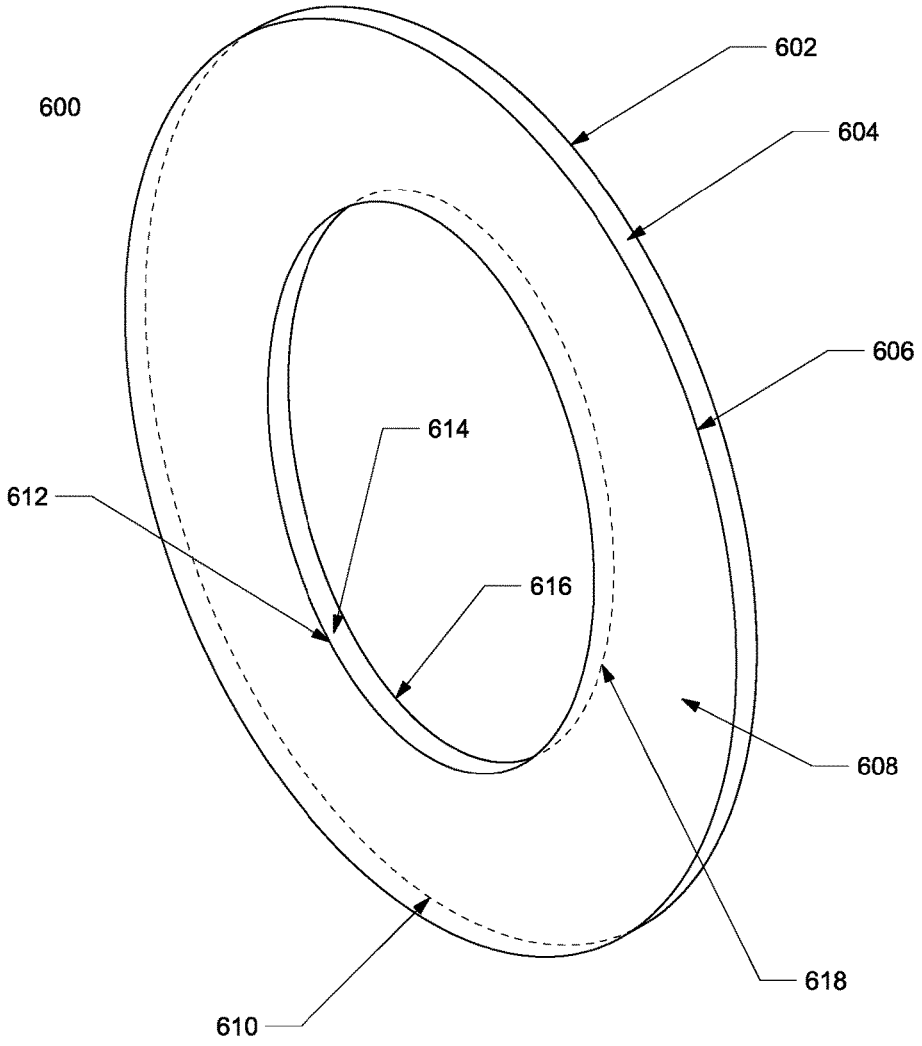
FIG. 6 is a perspective isometric view of an inner liner of an embodiment of the present invention.

FIG. 6 is a perspective isometric view of an embodiment of an inner liner 600 of the headphone protector. Here, the orientation is such that the front face 608 of the inner liner 600 is shown; the front face attaches to the outer component of the headphone protector and faces away from the ear cushion when in use. Inner Oliner 600 may be detachable or non-detachable from the outer component. The inner liner may have, in some embodiments, external rim 604 with a thickness that extends from external edge 602, 610 of the rear face of the inner line to 606, the external edge of the front face of the inner liner. The external rim 604 may be of different thicknesses in various embodiments, or vary in thickness within a single embodiment. The internal rim 614 extends from internal edge of the front face of the inner liner 612 to the internal edge of the rear face of the internal liner 616. The internal rim 614 may be of different thicknesses in various embodiments, or vary in thickness within a single embodiment. In some embodiments, the inner liner may be directly attached to the outer component via the inner face 608, such as via any method known in the art, such as adhesive or stitching. In other embodiments, the inner liner may be detachable, via a surface such as Velcro, or metal or plastic snaps, or any suitable method known in the art. In some embodiments, the attachment method will be washable, that is, maintain its integrity after being washed.

Figure 7:
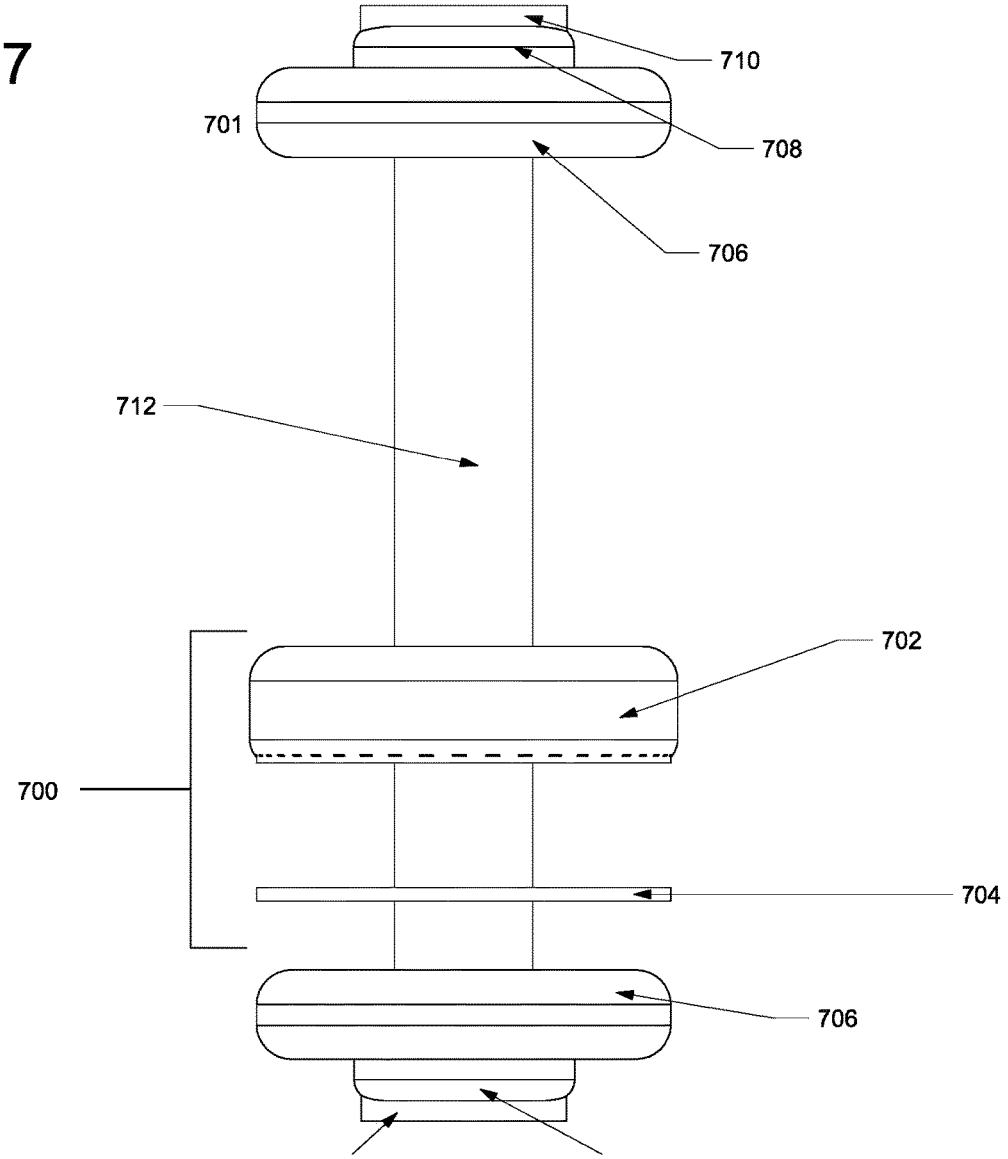
FIG. 7 is a perspective bottom-view of example headphones and the order in which the present invention may be assembled in respect to the headphone ear cushion in an embodiment of the present invention.

FIG. 7 is a perspective bottom view of an example embodiment of headphone protector 700 depicts how the headphone protector assembles in regards to the headphone 701. Outer component 702 is the component of the headphone protector that will be in direct contact with the users' ear. Inner liner 704 is an inside component of the headphone protector that serves as the second defense against sweat that may penetrate the outer layer in some embodiments. Headphone protector 700 fits over ear cushion 706, and extends to speaker 708, which contains the speaker portion of the headphones. In this example embodiment, headband 712 attaches at the ear cushion/speaker module 706/708 at 710 (other configurations are possible depending on headphone model.

Figure 8:
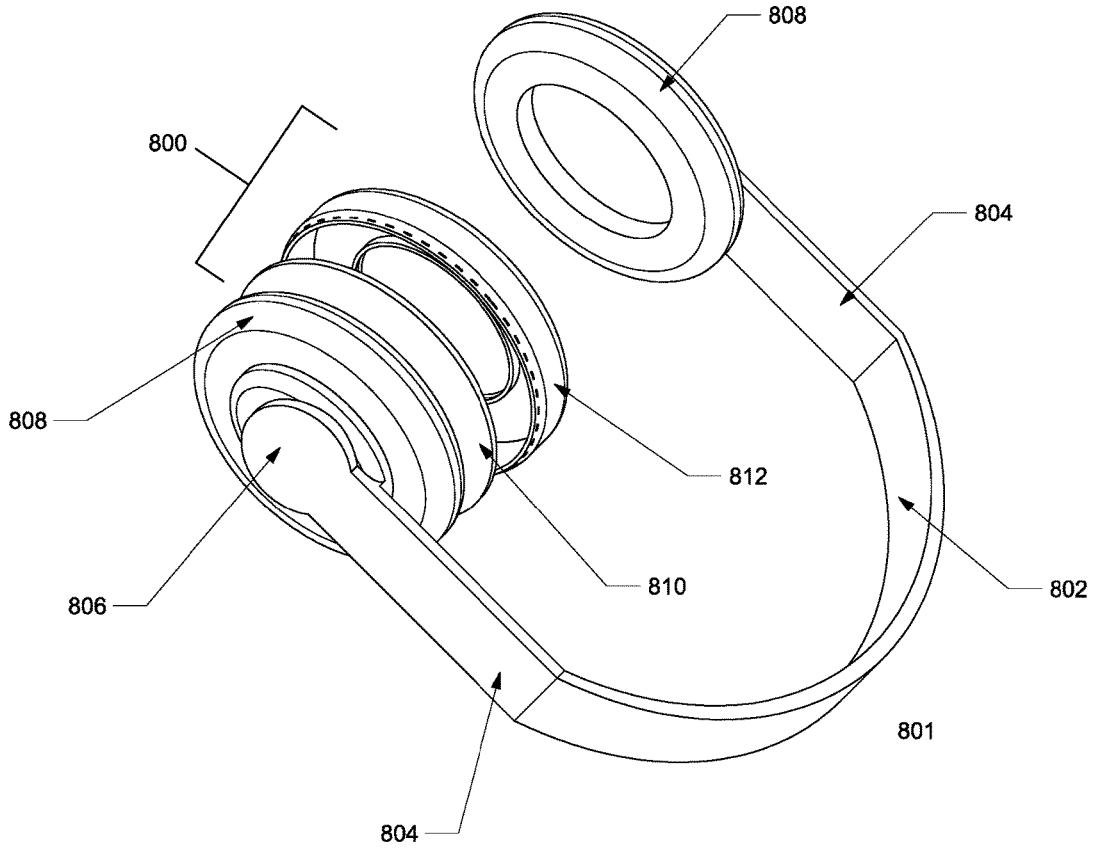
FIG. 8 is a perspective bottom hinge-view of the order in which an embodiment of the present invention may be assembled, illustrates how the components fit together from a back angle onto the ear cushion.

FIG. 8 is a perspective side hinge view that illustrates how an example embodiment of the headphone protector 800 assembles on headphone 801 from the opposite direction. Protector 800 may be fit over left or right ear cushions 808, 810. The ear cushions 808, 810 are attached to the headband 806, which is comprised of lateral sections 804 and top section 802. As can be seen from the figure, a headphone protector 800 can be slipped over an ear cushion 810, prior to use of the headphone. In this particular embodiment, the inner layer is not detachable, in contrast to FIG. 9.

Figure 9:
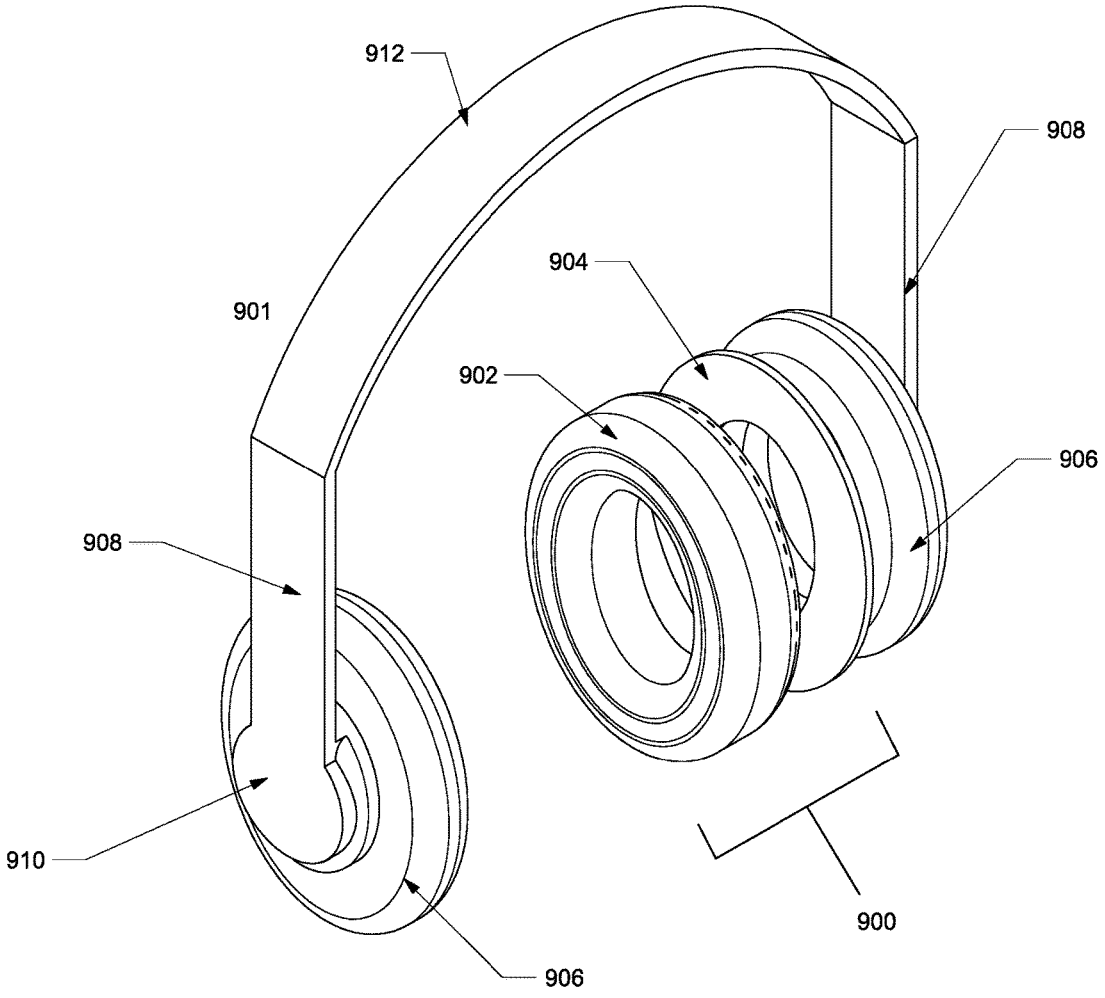
FIG. 9 is a perspective isometric-view of an embodiment of the present invention and how it is assembled in regards to the ear cushion of an example headphone.

FIG. 9 is a perspective isometric view illustrating how the headphone protector 900 assembles in respect to the headphone 901 and ear cushion 906. The ear cushion 906 is attached to the headband at 910. The headband further comprises lateral portion 908 and top portion 912. In this embodiment, 902 is the outer component 902 is detachable from the inner liner 904 the headphone protector 900.

Figure 10:
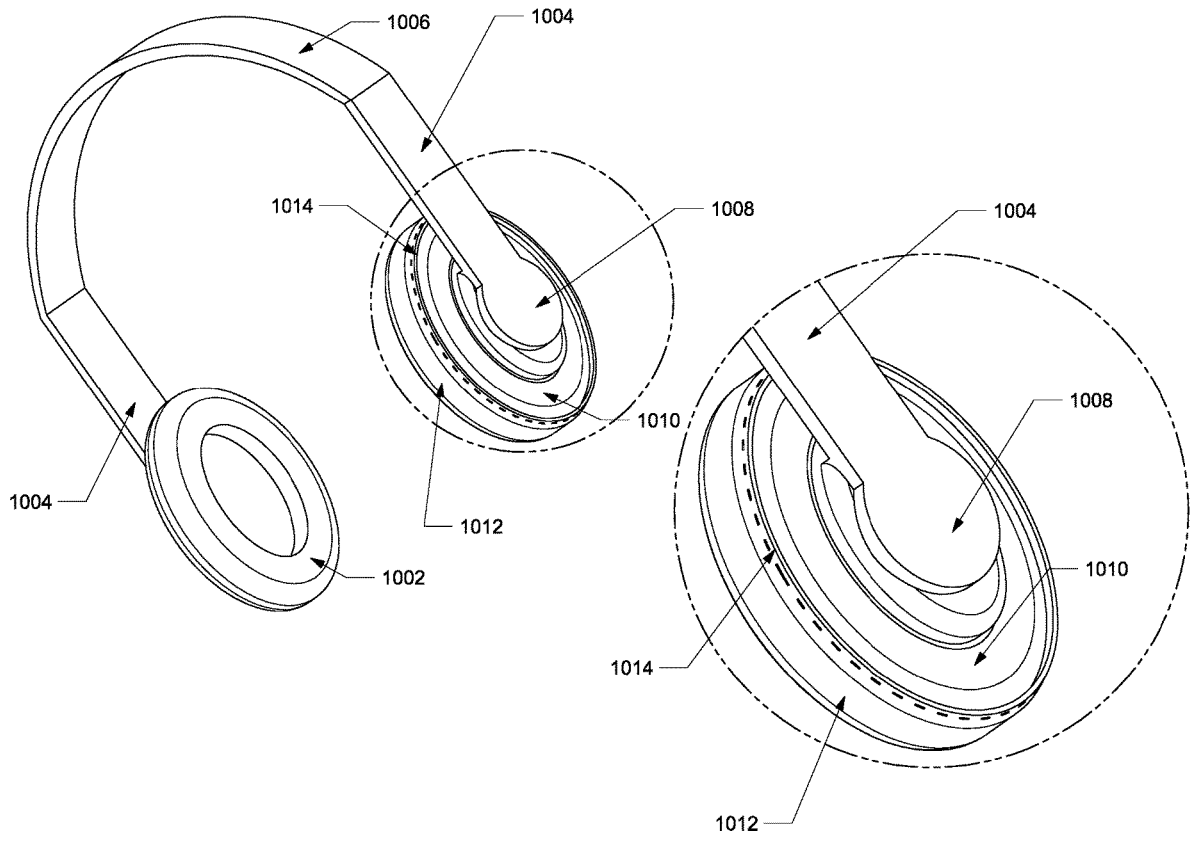
FIG. 10 is a perspective front view of an example headphone with an embodiment of the present invention assembled and attached to the headphone. Also shown is a zoomed-in view to illustrate how the embodiment of the present invention fits onto the ear cushion of the example headphone.

FIG. 10 is a perspective isometric hinge view of an example embodiment of the headphone protector 1012 attached to an ear cushion 1102 of the headphone. The external rim 1014 of the head phone protector wraps all the way around the right ear cushion (such that it is not seen) to the edge of speaker 1010. The speaker 1010 attaches to the head band at 1108, which also comprises lateral areas 1004 and top portion 1006.

Figure 11:
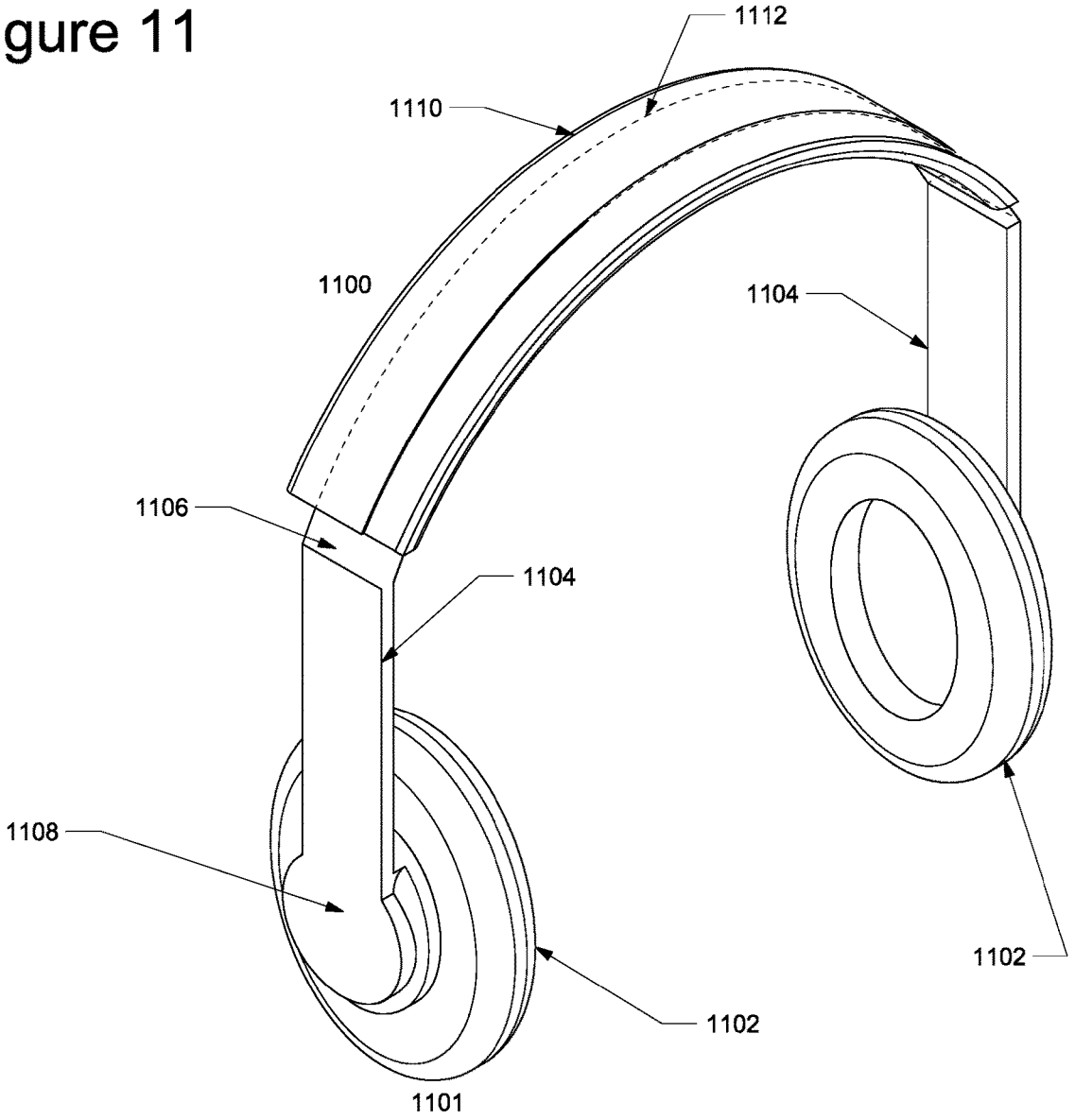
FIG. 11 is an isometric perspective view of the headband protector embodiment of the present invention attached to example headphones.

FIG. 11 is a top perspective view of a headband protector 1100 of the present invention, shown in use on a headphone with ear cushions 1102, and a headband attached to the ear cushions 1102 at 1108 with lateral sides 1104 and top portion 1106. In some embodiments headband protector 1100 beginning at edge 1112 wraps around top portion 1106 of the headband and is held in place by overlapping portion 1210 over and past edge 1112. The overlap may be held in place by Velcro or any other detachable fastener known in the art. Headband protector 1110 may be, in some embodiments, washable.

The outer component may be made of any suitable fabric. In many embodiments, the fabric is washable. In other embodiments, the fabric is water (e.g., sweat) absorbent. In some embodiments, the material is neoprene or a similar fabric, such as lycra, polyester, nylon, polybutylene terephthalate (PBT) polyester, XLA fabric, or a blend of these or other materials. In other embodiments, the outer component may contain cotton, or another natural fiber.

The outer component material may have any degree of flexibility desired. In many embodiments, the flexibility of the material is such that the ear cushions of the headphones are not greatly compressed when the earphone protector is stretched over the ear cushions. In some embodiments, the material of the outer component and/or inner layer will be sufficiently sized so as to not compress the ear cushions when fit over the ear cushions. In some embodiments, the outer component is shaped with one or more seam and/or permanent crimps placed in the material (e.g., at areas corresponding to the external edge of the ear cushion) to allow the headphone protector to be easily fit over the ear cushions and not compress the ear cushion material unduly. In some embodiments, the external rim, seams and/or crimps, and/or internal rim form concentric circles, ellipses or a combination of both when fit over an ear cushion.

In some embodiments, the inner liner may or may not be present. In some embodiments, the inner liner is made out of waterproof material in order to avoid damage to the headphones. In some embodiments, the inner layer is made out of latex, or neoprene, or other such material or a blend of materials. The inner liner may have any degree of flexibility desired. In many embodiments, the flexibility of the material is such that the ear cushions of headphones are not greatly compressed when the earphone protector is stretched over the ear cushions. In some embodiments, the inner liner is simply sprayed onto or otherwise attached to the inside of the outer component. In some embodiments, the inner layer is detachable from the outer component.

In some embodiments, the external rim and/or internal rim are reinforced, i.e., thicker or otherwise stronger than other parts of the outer component and/or inner layer. In some embodiments, the external rim and internal rim are reinforced with stitching. In other embodiments, the external rim and/or internal rim have elastic or similar material stitched or otherwise attached to them, in order to gather and hold the headphone protector about the ear cushions. In other embodiments, elastic or other similar materials are added to areas in addition to and/or other than the internal and external rims.

In some embodiments, a headband protector may work alone or in tandem with earphone protectors to avoid damage to the headphones. In some embodiments, the headband protector may be made of any suitable fabric. In many embodiments, the fabric is washable. In other embodiments, the fabric is water (e.g., sweat) absorbent. In some embodiments, the material is neoprene or a similar fabric, such as lycra, polyester, nylon, polybutylene terephthalate (PBT) polyester, XLA fabric, or a blend of these or other materials. In other embodiments, the outer component may contain cotton, or another natural fiber.

The headband material may have any degree of flexibility desired. In many embodiments, the flexibility of the material is such that the headband material may be stretched over itself to allow for easy fastening over a headband.

In some embodiments of the headband, an inner liner may or may not be present. In some embodiments, the inner liner is made out of waterproof material in order to avoid damage to the headphones. In some embodiments, the inner layer is made out of latex, or neoprene, or other such material or a blend of materials. The inner liner may have any degree of flexibility desired. In many embodiments, the flexibility of the material is such that the headband material may be stretched over itself to allow for easy fastening over a headband.

In some embodiments, the outer component is approximately 0.3-0.5 mm thick. In some embodiments, the inner layer is approximately 0.3-0.5 mm thick. In some embodiments the headband protector and headphone protector are approximately 0.3 to 1 mm thick, 1 mm to 3 mm thick.

Operation

In operation, in some embodiments of the present invention the headphone protector is placed over the headphone ear cushions by stretching the external rim around the ear cushion of a headphone. In some embodiments, an elastic band attached to the headphone protector binds the headphone protector to the ear cushion, and holds it in place while headphones are in use. While the headphone protector is attached to the ear cushion, headphones are then put over the ears and adjusted to the appropriate fit. In order to remove the headphone protector from the headphone, the elastic band must be stretched from around the back of the ear cushion.

The operation of the headband protector is to place the bottom part of the headphone headband inside of the headband protector; then wrap the bottom flap of the headband protector around the headphone first, then wrap the top portion of the headband protector around the bottom flap. In some embodiments, the flaps are held together while in use by Velcro or some other suitable fastener. In order to remove the headphone protector, the user must grab the top portion of the headband protector and pull until the Velcro strap releases the bottom portion of the headband protector.

What is claimed is:

1. A removable headphone earcup protector wherein said earcup is worn over-ear and comprises a ear cushion, wherein said protector comprises an outer component comprising a single, seamless fabric capable of fitting over the front and at least in part the side of said headphone ear cushion, wherein said seamless fabric is shaped with one or more lines of stitching placed in the fabric at areas corresponding to the external edges of the ear cushion allowing the removable headphone protector to closely conform to the shape of the front and side of the ear cushion when fitted over the ear cushion, wherein said seamless fabric is water-resistant.

2. The removable headphone earcup protector of claim 1, wherein said protector further comprises a water-absorbent fabric.

3. The removable headphone earcup protector of claim 1, wherein said outer component comprises an inner and outer surface, wherein said inner surface is waterproof.

4. The removable headphone earcup protector of claim 3, wherein said outer component has a lesser stiffness located at the portion of the outer component frontward of said one or more lines of stitching and a greater stiffness in the portion backward of said one or more lines of stitching.

5. The removable headphone earcup protector of claim 1, wherein said protector further consists of an inner liner material, wherein said inner liner material is fused to the outer component.

6. The removable headphone earcup protector of claim 1, wherein said protector further consists of an inner liner material, wherein said inner liner material is detachable from the outer component.

7. The removable headphone earcup protector of claim 1, wherein said outer component comprises an internal rim that defines a hole in front of the speakers of said earcup and wherein said internal rim is reinforced with a seam and/or stitching.

8. The removable headphone earcup protector of claim 1, wherein said outer component comprises an external rim that is reinforced with a seam and/or stitching.

9. The removable headphone earcup protector of claim 1, wherein said outer component is comprised of at least one line of stitching and at least one crimp in the seamless fabric.

10. The removable headphone earcup protector of claim 1, further comprising a removable headband protector, wherein said removable headband protector comprises a water resistant fabric.

11. A removable headphone earcup protector, wherein said earcup is worn over-ear and comprises a ear cushion, comprising an outer component comprising a seamless fabric capable of fitting over the front and at least in part the side of said ear cushion, wherein said seamless fabric is shaped with one or more permanent crimps placed in the single fabric at areas corresponding to the external edge of the ear cushion to allow the protector to closely conform to the shape of the front and side of the ear cushion when placed on the ear cushion, wherein said seamless fabric is water-resistant.

12. The removable headphone earcup protector of claim 11, wherein said protector further comprises a water-absorbent fabric.

13. The removable headphone earcup protector of claim 11, wherein said outer component comprises an inner and outer surface, wherein said inner surface is waterproof.

14. The removable headphone earcup protector of claim 11, wherein said protector further consists of an inner liner material, wherein said inner liner material is fused to the outer component.

15. The removable headphone earcup protector of claim 14, wherein said protector has a greater stiffness than the ear cushion such that it retains its shape in normal use after being removed from the ear cushion.

16. The removable headphone earcup protector of claim 11, wherein said protector further consists of an inner liner material, wherein said inner liner material is detachable from the outer component.

17. The removable headphone earcup protector of claim 11, wherein said outer component comprises an internal rim that defines a hole in front of the speakers of said earcups and wherein said internal rim is reinforced with a seam and/or stitching.

18. The removable headphone earcup protector of claim 11, wherein said outer component comprises an external rim that is reinforced with a seam and/or stitching.

* * * * *